United States Patent [19]

Racilla et al.

[11] 4,344,665

[45] Aug. 17, 1982

[54] CONNECTOR FOR MASS TERMINATING INDIVIDUAL CONDUCTORS

[75] Inventors: John J. Racilla; Robert N. Weber, both of Hummelstown, Pa.

[73] Assignee: AMP Incorporated, Harrisburg, Pa.

[21] Appl. No.: 202,854

[22] Filed: Oct. 31, 1980

[51] Int. Cl.[3] ..... H01R 4/24

[52] U.S. Cl. ..... 339/99 R

[58] Field of Search ..... 339/97, 98, 99

[56] References Cited

U.S. PATENT DOCUMENTS

| | | | |
|---|---|---|---|
| 3,860,318 | 1/1975 | Reavis | 339/99 R |
| 3,868,161 | 2/1975 | Frantz | 339/97 X |
| 3,985,416 | 10/1976 | Dola et al. | 339/98 |
| 4,160,573 | 7/1979 | Weisenburger | 339/99 R |
| 4,209,219 | 6/1980 | Proietto | 339/99 R |
| 4,243,288 | 1/1981 | Lucius et al. | 339/99 R |

*Primary Examiner*—Joseph H. McGlynn
*Assistant Examiner*—John S. Brown
*Attorney, Agent, or Firm*—Russell J. Egan

[57] ABSTRACT

An electrical connector is disclosed having the capability of mass terminating a plurality of individual conductors. The connector includes a housing having a plurality of terminals positioned therein in at least one row. Each terminal has a mating end directed toward a mating front face of the housing and an insulation displacing, conductor engaging portion which lies in an exposed rear portion of the housing. A cover member associated with the housing overlies the conductor engaging portion of the terminals and receives and drives the conductor into a respective terminal and to effect engagement of the terminal and the conductor.

6 Claims, 10 Drawing Figures

Fig. 8
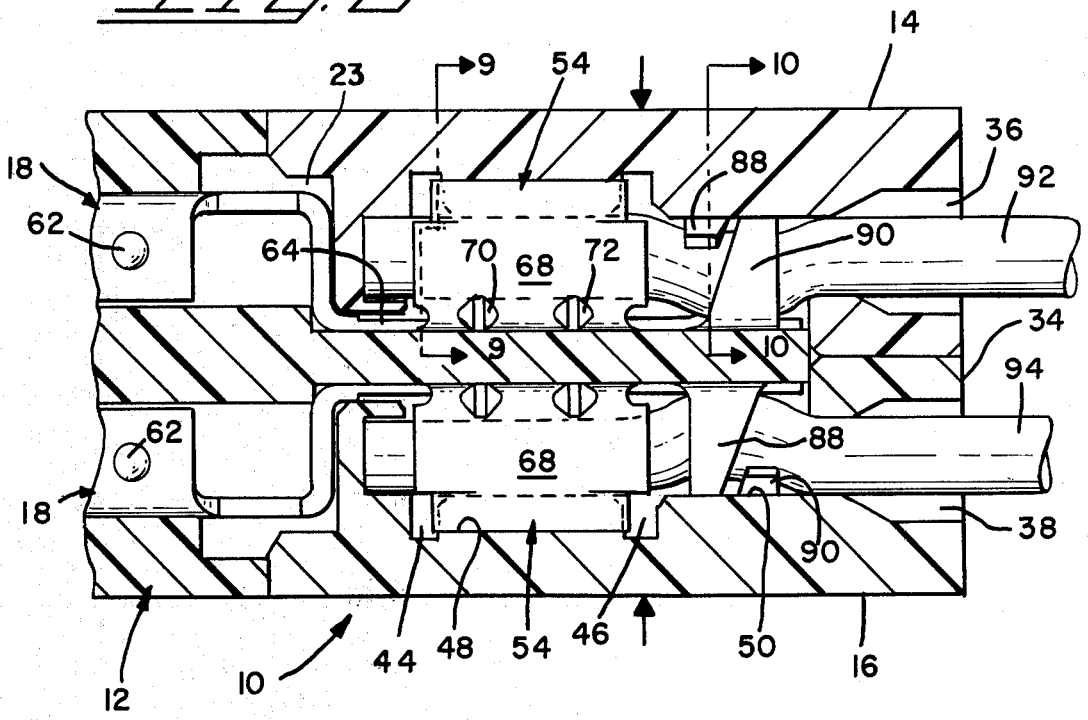
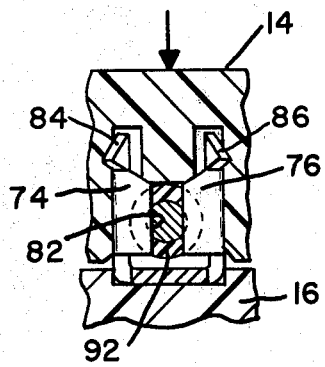
Fig. 9
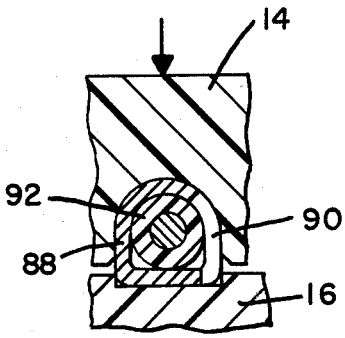
Fig. 10

CONNECTOR FOR MASS TERMINATING INDIVIDUAL CONDUCTORS

BACKGROUND OF THE INVENTION

1. The Field Of The Invention

The present invention relates to an electrical connector for mass terminating a plurality of individual conductors.

2. The Prior Art

There are usually a number of problems that are encountered in attempting to mass terminate individual conductors. These problems are usually of sufficient magnitude that the conductors wind up being terminated one at a time or, at best, two at a time for instances where the connector has a pair of oppositely and outwardly directed terminals. Thus, it has heretofore been a rather slow and tedious process to terminate cables that are formed by a plurality of individual insulated conductors.

SUMMARY OF THE INVENTION

The present invention is intended to facilitate mass termination of multiple individual conductors in a single electrical connector. The subject connector includes a housing having a mating front face and an open rear terminating portion with a plurality of terminal passages extending therebetween in parallel spaced fashion in at least one row. A plurality of terminals are mounted in the housing, each in a respective passage. Each terminal has an insulation piercing, conductor engaging rear portion which lies in the open rear terminating portion of the housing. A cover is associated with and encloses the open rear terminating portion of the housing. The cover receives the individual conductors and drives them into respective terminals thereafter applying a crimping force to a strain relief portion of the terminal to assure that the conductor will stay in engagement therewith.

It is therefore an object of the present invention to produce an improved connector for mass terminating individual conductors.

It is a further object of the present invention to produce an improved electrical connector which can mass terminate individual conductors with and can be used to mate the thus terminated conductors a known connector or with the edge of a printed circuit board.

It is another object of the present invention to produce a connector for terminating multiple individual conductors with cover portions of the connector driving the conductors into insulation piercing engagement with respective terminals and subsequently crimping the terminals to assure permanent strain relieved engagement.

It is a further object of the present invention to produce an improved electrical connector which can be readily and economically manufactured.

The means for accomplishing the foregoing objects and other advantages will become apparent to those skilled in the art from the following detailed description taken with reference to the accompanying drawings.

BRIEF DESCRIPTION OF THE DRAWINGS

FIG. 8 is a partial section through the connector as shown in FIG. 4;

FIG. 9 is a detailed section taken along line 9—9 of FIG. 8; and

FIG. 10 is a detailed section taken along line 10—10 of FIG. 8.

DETAILED DESCRIPTION OF THE PREFERRED EMBODIMENT

Figure 1:
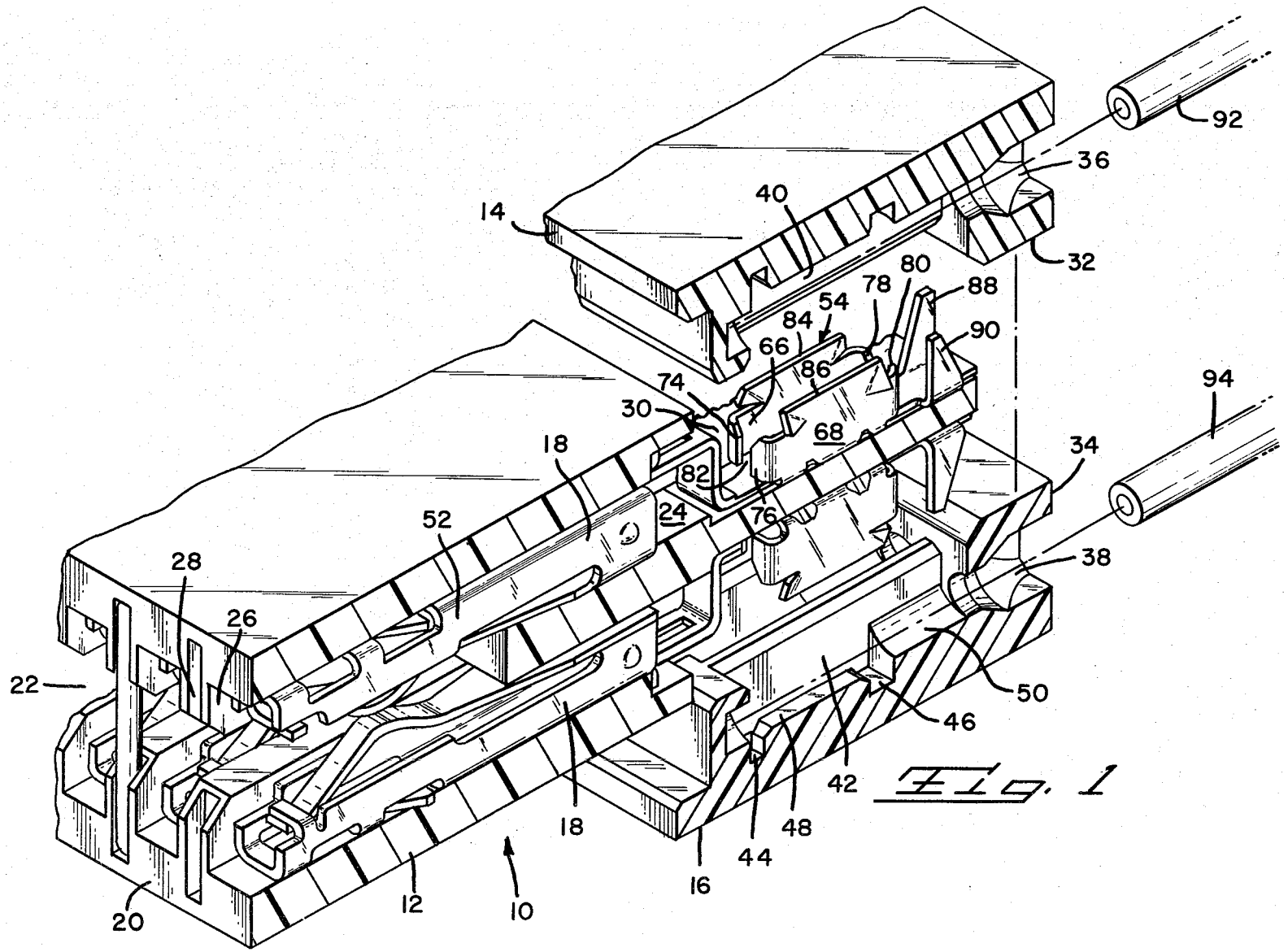
FIG. 1 is an exploded perspective taken in transverse section through a connector according to the present invention.

The subject connector 10 has a housing 12 of rigid insulative material with a pair of associated cover members 14, 16, also of rigid insulative material, and a plurality of terminals 18. The housing 12 has a mating front face 20 shown here with an elongated circuit board receiving slot 22 formed therein, and a rear terminating portion 23. A plurality of terminal passages 24 extend through the housing 12 and open onto the slot 22 as a series of parallel, spaced, inwardly directed channels 26, defining walls 28 between adjacent terminals 18. The rear terminating portion 23 of the housing 12 is outwardly and rearwardly open to form a sort of shelf or platform 30.

The cover members 14, 16 each have a profiled, depending rear wall 32, 34 with a plurality of bores 36, 38 therein. Each bore 36, 38 leads to a respective profiled recess 40, 42. When the covers 14, 16 are positioned on the rear shelf 30 of the housing 12, the rear walls 32, 34 and the recesses 40, 42 serve to form a plurality of enclosures. The recesses 40, 42 are profiled to include spaced depressions 44, 46 at opposite ends of an inwardly directed pusher surface 48 and an inwardly directed rear crimping surface 50. The covers 14, 16 include keying means (see FIGS. 2 to 4) for positioning them with respect to the housing 12.

The individual terminals 18 each include a forward mating portion 52, such as the circuit board engaging profile shown and a rear insulation piercing conductor engaging portion 54. The mating portion 52 is shown formed with a channel configuration 56 having an overlying, forwardly directed cantilever spring arm 58 which has its free end restrained under cross flange 60. Each terminal also preferably includes a detent 62 or lance (not shown) for locking the terminal 18 in the housing 12.

The conductor engaging portion 54 of each terminal 12 is formed by a base plate 64 having a pair of parallel spaced upstanding side walls 66, 68 each with strengthening detents 70, 72 formed therein. Each side wall 66, 68 has an inwardly turned free end portion 74, 76, 78, 80 with the end portions defining slots 82 therebetween. Each side wall 66, 68 further includes a top flange 84, 86. The terminal is completed by a pair of strain relief ears 88, 90 extending from the base plate to the rear of the sidewalls 66, 68.

Figures 2, 3, 4:
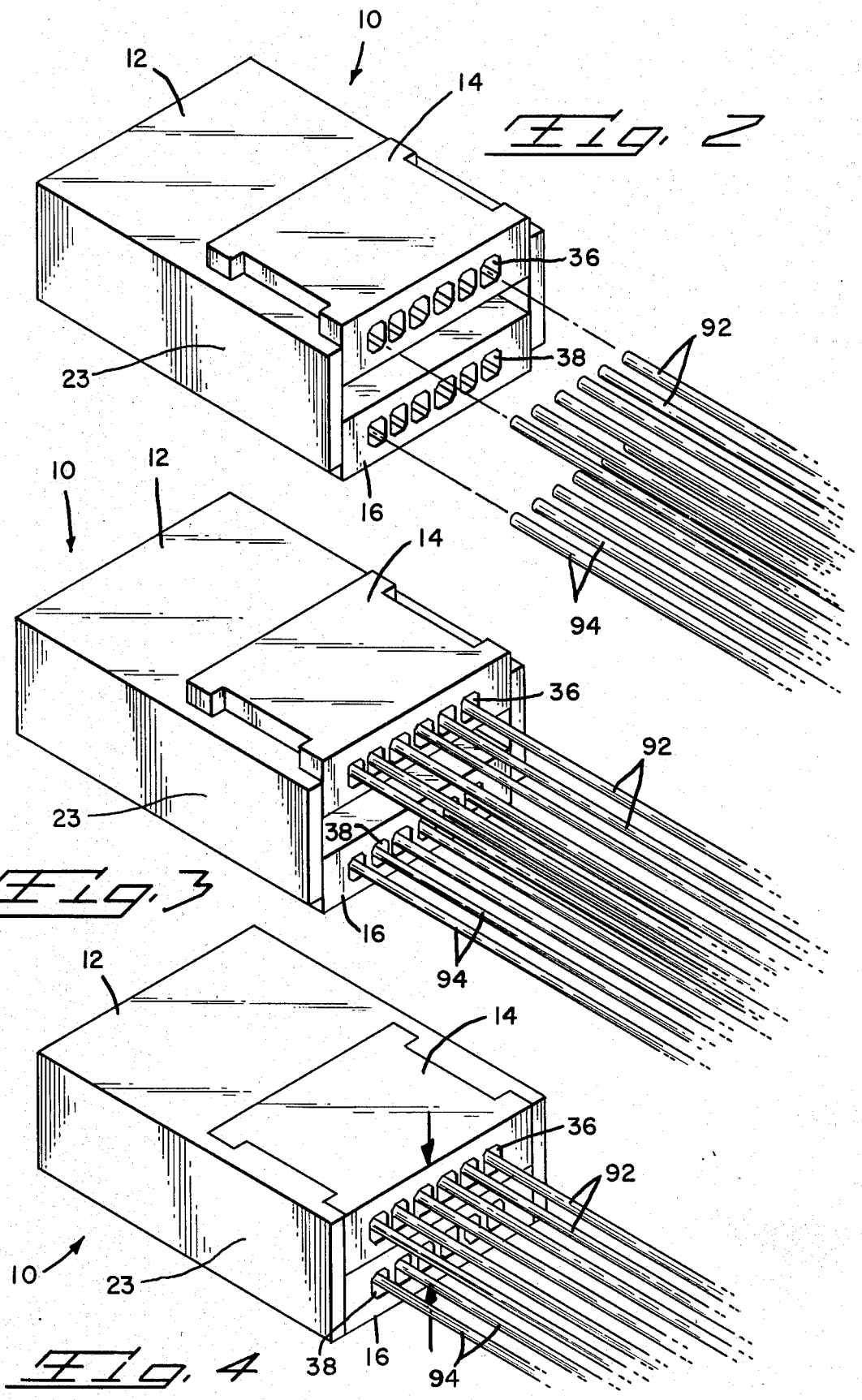
FIG. 2 is a perspective view of a connector according to the present invention with a plurality of individual conductors exploded therefrom.
FIG. 3 is a perspective view of a connector according to the present invention with conductors inserted therein.
FIG. 4 is a perspective view of an electrical connector according to the present invention in a fully terminated condition.
Figure 5:
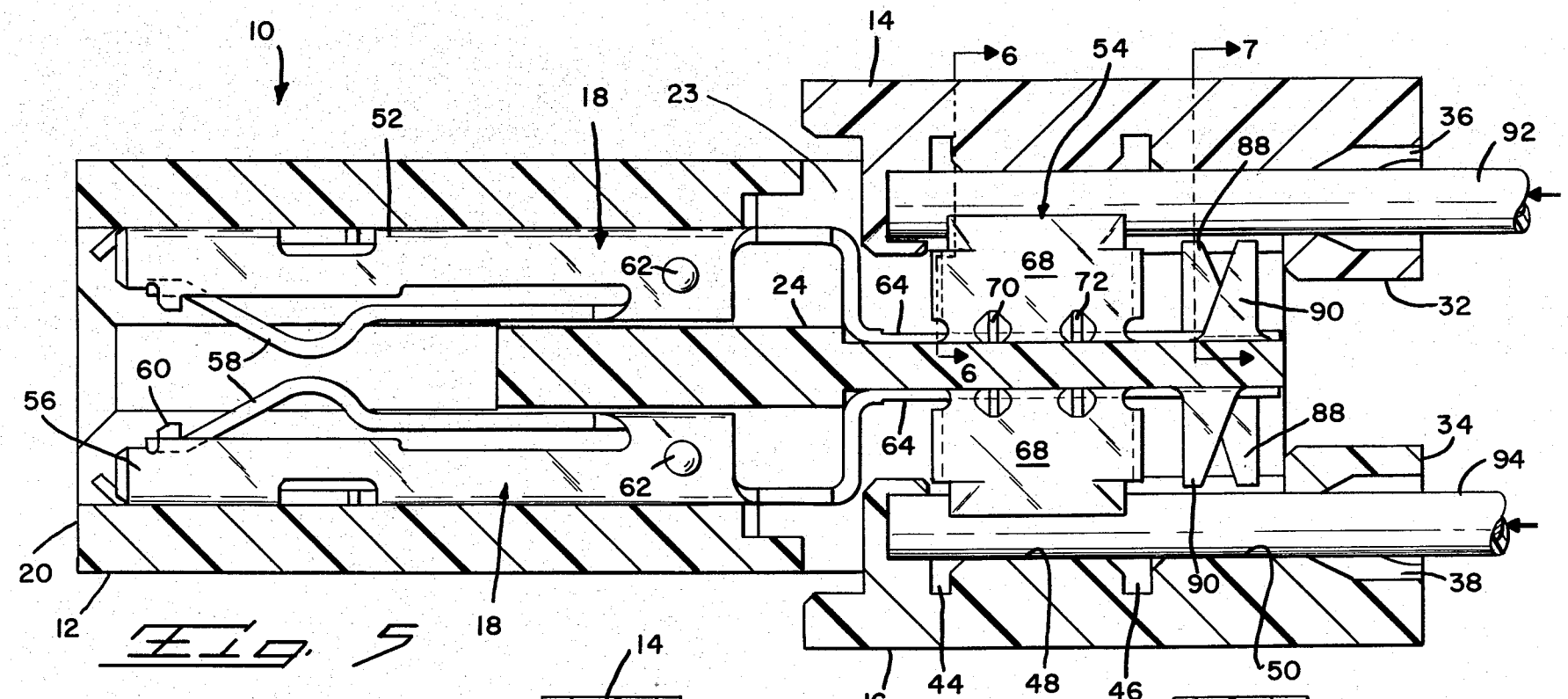
FIG. 5 is a transverse section through the subject connector in the condition shown in FIG. 3.
Figure 7:
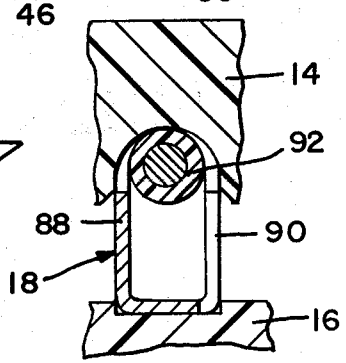
FIG. 7 is a detailed section taken along line 7—7 of FIG. 5.
Figure 6:
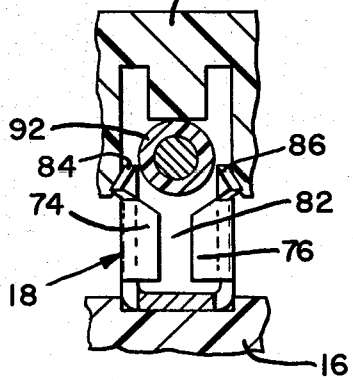
FIG. 6 is a detailed section taken along line 6—6 of FIG. 5.

The subject connector is utilized in the following manner, first the terminals 18 are loaded into the housing 12 to the position as shown in FIG. 1 and the covers 14, 16 are assembled to the housing 12 as shown in FIG. 2. The flanges 84, 86 of each terminal will engage respective recesses 40, 42 to hold the covers 14, 16 on the housing 12 as shown in FIG. 6. Next, a plurality of individual, unstripped insulated conductors 92, 94 are aligned with the respective openings 36, 38 in the covers 14, 16 and inserted therein as shown in FIGS. 3 and 5. The front wall of the respective covers will serve as a stop for the conductors. In this position it will be noted that the conductors are lined up parallel to and spaced above the conductor engaging portion 54 of each respective terminal 18. The conductors are also restrained from lateral movement by the profiling of the recesses 40, 42 in the covers 14, 16 respectively. A uniform force is applied to the covers from opposite sides of the housing 12 to drive the covers together and into the housing as shown in FIG. 4. The consequence of this movement is that the pusher surfaces 48 initially drive the conductors 92, 94 into the respective slots 80, 82, as shown in FIG. 9, and the crimping surfaces 50 crimp the strain relief ears 88, 90 against the insulation of the conductor, as shown in FIG. 10. Thus the conductor will have the insulation pierced by the end portions 74, 76, 78, 80 at two spaced locations to assure termination and will be fully secured in the terminal by the crimped strain relief ears 88, 90 so as to not be readily removable therefrom.

The present invention may be subject to many modifications and changes without departing from the spirit or essential characteristics thereof. The present embodiment should therefore be considered in all respects as illustrative and not restrictive of the scope of the invention.

What is claimed is:

1. A connector for terminating a plurality of individual insulated conductors in gang fashion, said connector comprising:

a housing of insulative material having a front mating face and a rear terminating portion with a plurality of terminal passages extending therebetween in parallel spaced fashion in at least one row, said rear terminating portion of said housing being outwardly and rearwardly open;

a cover mating with said open rear terminating portion of said housing, said cover having an inwardly directed pusher surface and crimp means associated with each said terminal passage and a rear wall enclosing said open rear terminating portion;

a plurality of apertures in said rear wall each opening into a respective one of said passages, and means in said cover aligned with each respective aperture for engaging and restraining a conductor; and a plurality of terminals each mounted in a respective passage, each said terminal having a mating portion directed towards said front mating face and an insulation piercing conductor engaging portion and strain relief means both lying in said rear terminating portion of said housing, whereby a plurality of conductors received in said cover are driven by said cover pusher surfaces into said insulation piercing conductor engaging portions of respective terminals and said strain relief means is crimped against a conductor by closure of said cover with respect to said housing.

2. A connector according to claim 1 wherein the conductor engaging portion of each said terminal comprises a base portion having integral side walls extending normally therefrom in parallel spaced relation, end portions of each side wall being inturned towards each other forming a pair of parallel spaced slots of a width to effect insulation piercing conductor engagement.

3. A connector according to claim 2 further comprising:

a flap at the upper free edge of each said sidewall, said flap engaging in a respective slot of an adjacent cover to hold said cover with respect to said housing in an unterminated condition.

4. A connector according to claim 1 further comprising guide means for guiding said cover with respect to said housing.

5. A connector according to claim 1 wherein said mating face is profiled to receive an edge of a printed circuit board therein.

6. A connector according to claim 1 wherein said mating face is profiled to receive a printed circuit board therein and said terminal passages are arranged to pass on either side of said board, said terminals being arranged in two parallel rows whereby opposite sides of said circuit board are simultaneously engaged.

* * * * *